US005655923A

United States Patent [19]

Thompson

[11] Patent Number: 5,655,923

[45] Date of Patent: Aug. 12, 1997

[54] LATCH MECHANISMS FOR LOCKING TAPER CONNECTORS

[75] Inventor: Kenneth C. Thompson, Stillwater, Minn.

[73] Assignee: Minnesota Mining and Manufacturing Company, St. Paul, Minn.

[21] Appl. No.: 441,074

[22] Filed: May 15, 1995

[51] Int. Cl.[6] ..... H01R 13/28

[52] U.S. Cl. ..... 439/291

[58] Field of Search ..... 439/259, 262, 439/290, 291, 284, 342, 261

[56] References Cited

U.S. PATENT DOCUMENTS

| | | | |
|---|---|---|---|
| 3,264,601 | 8/1966 | Hartholz | 339/176 |
| 3,601,759 | 8/1971 | Barker | 439/262 |
| 3,941,446 | 3/1976 | Cantwell | 439/262 |
| 4,050,759 | 9/1977 | Jackson, III et al. | 339/75 M |
| 4,487,467 | 12/1984 | Guerrero | 439/284 |
| 4,604,799 | 8/1986 | Gurol | 29/847 |
| 4,850,889 | 7/1989 | LaSota | 439/262 |
| 4,861,640 | 8/1989 | Gurol | 428/137 |
| 5,015,207 | 5/1991 | Koepke | 439/886 |
| 5,071,363 | 12/1991 | Reylek et al. | 439/291 |
| 5,176,530 | 1/1993 | Reylek et al. | 439/290 |

FOREIGN PATENT DOCUMENTS

| | | |
|---|---|---|
| 0 043 199 | 1/1982 | European Pat. Off. . |
| 1 540 217 | 1/1970 | Germany . |
| 1 029 721 | 5/1966 | United Kingdom . |

OTHER PUBLICATIONS

"Coefficient of Friction of High Polymers as a Function of Pressure," Bowers, *Journal of Applied Physics,* vol. 42, No. 12, Nov. 1971, pp. 4961–4970.

*Primary Examiner*—P. Austin Bradley
*Assistant Examiner*—Yong Kim
*Attorney, Agent, or Firm*—Gary L. Griswold; Walter N. Kirn; H. Sanders Gwin, Jr.

[57] ABSTRACT

An electrical connector having two correspondingly configured electrically conducting members includes a fail safe mechanism which enhances and maintains the interlocking engagement between the members. The fail safe mechanism includes a latching structures which apply horizontal forces to the connector. These horizontal forces are translated and resolved in a vertical direction such that member retention forces in the vertical direction are increased and electrical contacts among the correspondingly configured electrically conducting tapered elements of the members are increased.

11 Claims, 5 Drawing Sheets

LATCH MECHANISMS FOR LOCKING TAPER CONNECTORS

FIELD OF THE INVENTION

The present invention is directed to electrical connectors having members with complimentary tapered electrically conducting elements, which upon intermeshing, these elements form an interlocking engagement with a force sufficient to ensure an electrical connection. In particular, the present invention is directed to a structure which maintains and enhances the interlocking engagement forces, ensuring continuous electrical connections.

BACKGROUND OF THE INVENTION

Many types of electrical devices require connections that can be easily made and broken. However, many connectors with these capabilities loosen or break too easily. For example, as with a computer circuit board employing connectors such as those described above, a loosened or broken connection could result in lost data, as the circuit becomes open. As a direct result, worker hours are lost as the worker must reconstruct their data and a repair person must be called.

Currently, many electrical connectors have mechanisms that help to prevent the connections from breaking. For example, U.S. Pat. No. 3,601,759 (Barker) discloses a cam lever that must be pulled downward in order to make the electrical connections between the leads, closing the circuit. Similarly, in U.S. Pat. No. 4,850,889 (LaSota) the contacts are brought into proximity with each other. A wedge member then compresses the contacts together. This compression makes the electrical connection, closing the circuit, and maintains the connection until the wedge member is moved from its compressive position.

One type of electrical connector which forms an electrical connection upon members contacting each other is the Miniature Multiple Conductor Electrical Connector or locking taper connector disclosed in U.S. Pat. No. 5,071,363 (Reylek et al.). This connector includes two intermeshable members with major surfaces formed of a plurality of tapered elements. The tapered elements on the intermeshable members are complementary in order to intermesh in a frictional engagement. Each of the members includes an electrically insulative body and each member has electrically conductive segments along at least one side of each tapered element, the segments being arranged such that the segments touch, forming electrical connections upon intermeshing. The intermeshing creates an engagement, retained by frictional forces, resulting from the taper geometries disclosed in the Reylek et al. ('363) patent. These intermeshing forces are sufficient to maintain the electrical connections for substantial periods of time until the connectors are manually separated.

The disclosure in the Reylek et al. ('363) patent is incorporated herein by reference.

SUMMARY OF THE INVENTION

The present invention improves on these prior art systems through the provision of a mechanism for locking taper connectors, which enhances and maintains the interlocking engagement forces between the members, ensuring continuous electrical connections. The invention comprises an electrical (locking taper) connector oriented along horizontal and vertical axes having electrically conducting members with correspondingly configured electrically conducting tapered elements along the major surfaces. These tapered elements permit intermeshing of the members with a frictional interlocking force sufficient to ensure electrical connection. The invention includes additional structure for retaining and enhancing the electrical connections between the tapered elements, by applying a compressive force to at least one of the members, the compressive force being parallel to the horizontal axis, in order to increase the retention force along the vertical axis. This arrangement further enhances the frictional contacts, and ultimately the electrical connections, between the tapered elements.

BRIEF DESCRIPTION OF THE DRAWINGS

For a more complete understanding of this invention, reference should now be made to the embodiments illustrated in greater detail in the accompanying drawings that are described below.

In the drawings.

DETAILED DESCRIPTION OF THE DRAWINGS

Figure 1:
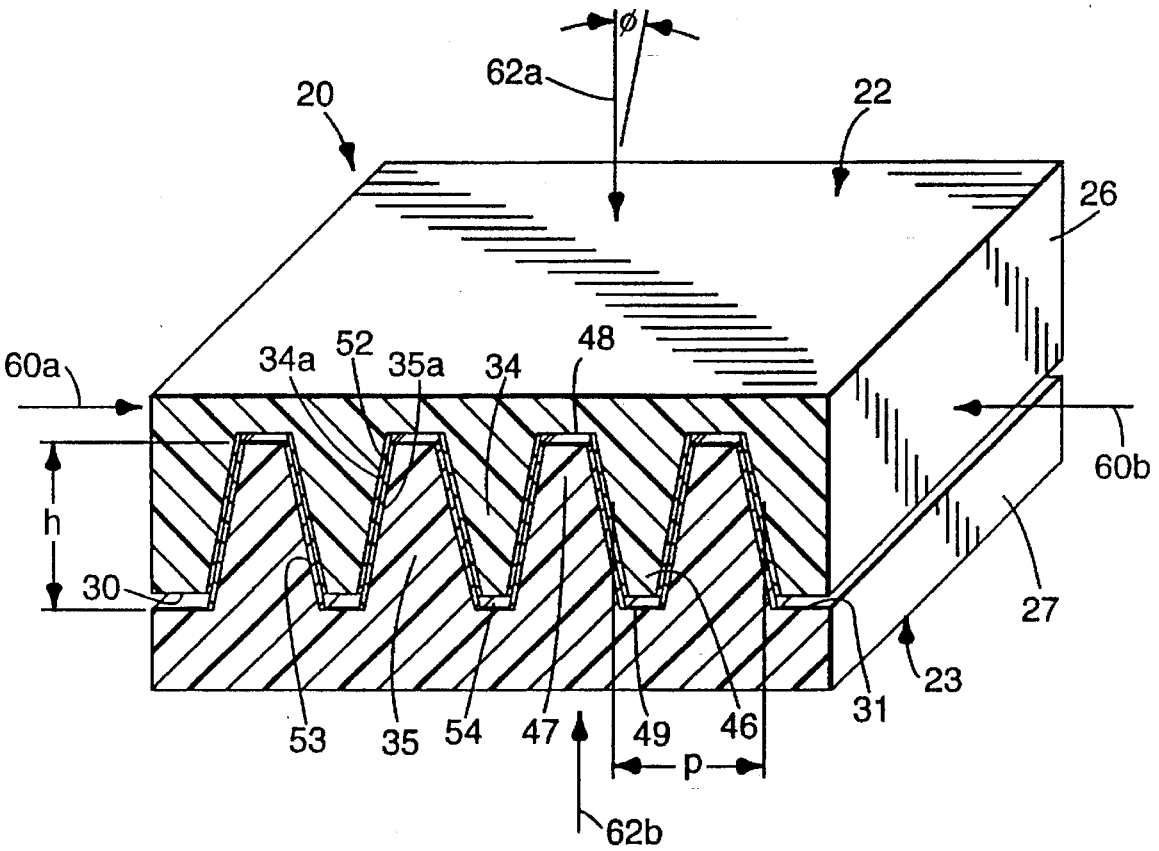
FIG. 1 is a cross sectional perspective view of the locking taper electrical connector used in conjunction with the present invention.

Turning now to FIG. 1 there is shown an electrical connector 20 for the present invention. The electrical connector is a locking taper connector, as disclosed in the Reylek et al. ('363) patent. The connector 20 includes two intermeshable members 22, 23 having electrically insulative bodies 26, 27. In this disclosure (illustrated in FIGS. 1–7), the intermeshable members 22, 23 will be referred to as the upper member 22 and the lower member 23. However, the terms "upper" and "lower" for the intermeshable members 22, 23 are descriptive only, as the members 22, 23 can be oriented in any manner desired, for the invention is not limited to these orientations for the members 22, 23.

Both members 22, 23 include major surfaces 30, 31 having a plurality of tapered elements 34, 35. These tapered elements 34, 35 form a plurality of linear ridges and grooves which are substantially parallel to each other and extend along each of the members 22, 23. The linear ridges and grooves terminate in crowns 46, 47 and troughs 48, 49 respectively. The tapered elements 34, 35 have two identically tapered sides 34*a*, 35*a*, each of which is covered with a metal segment 52, 53 or electrically conductive metal layers. When the members 22, 23 are intermeshed, the metal covered tapered sides 34*a*, 35*a* fit flush against each other in good electrical contact. To achieve this intermeshing, the tapered elements 34, 35 are shaped and have taper geometries in accordance with the Reylek et at. ('363) patent and U.S. Pat. No. 4,875,529 (Appeldorn). The disclosure in the Appeldorn ('529) patent is also incorporated herein by reference.

Each tapered element 34, 35 is sized such that when the tapered elements are brought into contact with one another to mesh, they will contact each other only along the tapered sides leaving a cavity 54 beyond the crown 46, 47 of each tapered element 34, 35, thus ensuring side contact. However, there need not be a cavity as long as the forces of contact at the crowns is not greater than the frictional forces associated with the sides.

Also, illustrated in this figure are axes, representative of the directions the forces are applied to the connector 20. Arrows 60*a*, 60*b* illustrate the horizontal latch axis while arrows 62*a*, 62*b* illustrate the vertical engagement axis.

The connector 20 is made from the materials and in accordance with the methods disclosed in the Reylek et al. ('363) patent. Additional materials for the bodies 26, 27 of the members 22, 23 may include polyetherimides, polyether sulfones and liquid crystal polymers.

Figure 2:
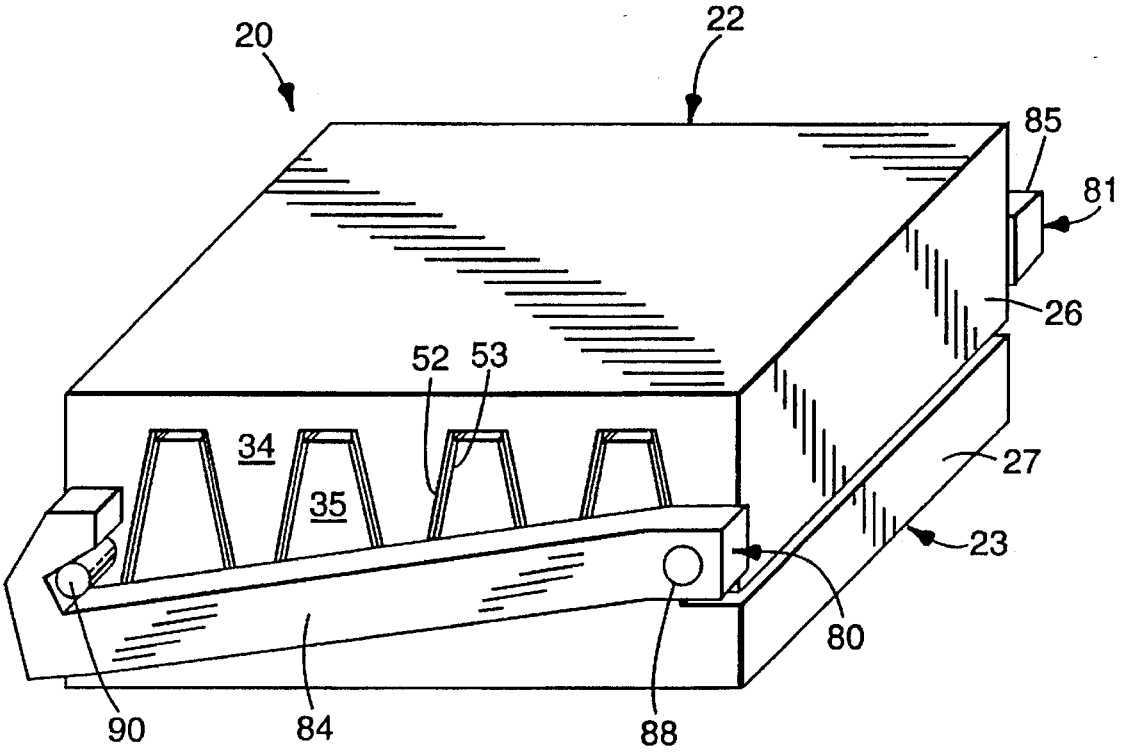
FIG. 2 is a perspective view of a first latch mechanism of the present invention.

FIG. 2 shows the locking taper connector 20 with snap-over latch mechanisms 80, 81 of the present invention. The snap-over latch mechanisms 80, 81 preferably span almost the entire width of the upper member 22 of the locking taper connector 20. As a result of this structure, the latch mechanisms 80, 81 are space efficient as they do not extend beyond the periphery of the members 22, 23 so as not to use up any additional vertical space, which is at a premium on stacked printed circuit boards.

Specifically, the snap-over latch mechanisms 80, 81 include flexible hooks 84, 85 attached to the first member 22 by a rigid pin 88 (only one shown) or other equivalent fastening structure. The flexible hooks 84, 85 surround and frictionally engage an outwardly extending segment 90 (only one shown). The resultant fastening places a compressive force on the horizontal latch axis 60*a*, 60*b* (FIG. 1), increasing the normal forces, ultimately increasing the frictional retention forces, creating an increased retention force in the direction of the vertical axis 62*a*, 62*b* (FIG. 1).

It is preferred that the latch mechanisms 80, 81 be applied across only one member, specifically the upper member 22. However, the flexible hooks 84, 85 and the outwardly extending segments 90 (only one shown) could be placed on different members 22, 23. Spacial considerations will dictate whether to place the flexible hooks or outwardly extending segments on which particular member.

While two latch mechanisms 80, 81 are shown on opposite sides of the member 22, one latch mechanism is also permissible. The positions of the hook, pin and outwardly extending segment may also be interchanged depending on the design desired and requisite spacial conditions. Alternately, a snap metal spring type latch or molded polymer part could be substituted for the snap-over latch mechanism.

Figure 7:
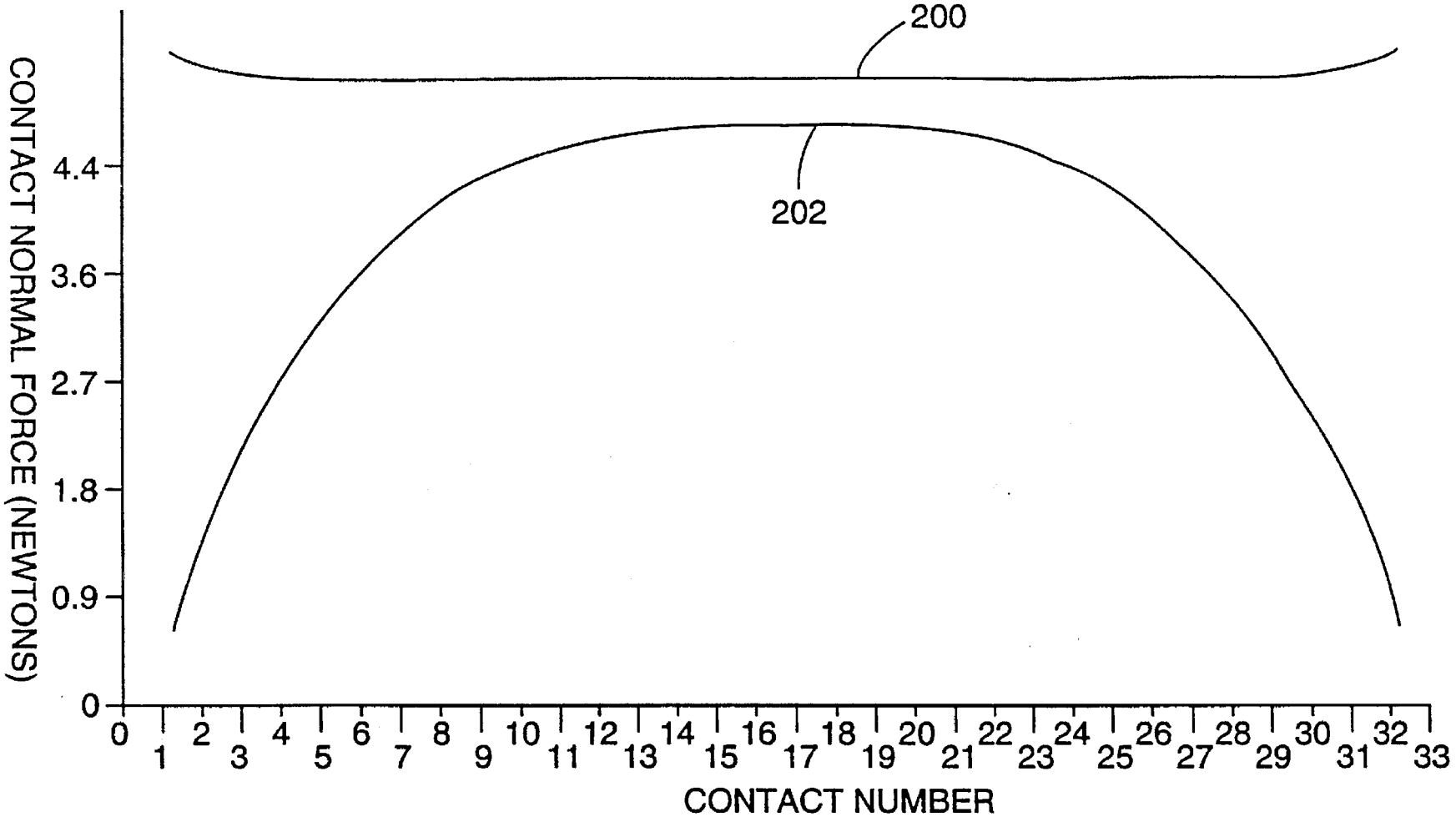
FIG. 7 is a mathematically modeled plot of Contact Normal Force along the length of the connector members, the length being expressed by the numbers of the contacts (tapered elements) from end to end.

The horizontal forces applied to the upper member 22 of the locking taper connector 20, provide for enhanced vertical retention, as the contact forces between members 22, 23 are augmented. As shown in FIG. 7, the addition of the latch mechanism of the invention further enhances the contact forces between the tapered elements (represented by their contact numbers on the abscissa), these contact forces being associated with maintaining the cooperating engagement of the taper lock connector 20. As illustrated by line 200, these contact forces are greater than those contact forces on the tapered elements of the locking taper connector 20 without the latch mechanism of the invention, as illustrated by line 202. As a result of the latch mechanisms, longer connectors having all active contacts (including those tapered elements at the ends of each member, contact numbers 1–4 and 30–33) can now be utilized. Line 202 illustrates the contact forces between tapered elements in the locking taper connectors absent the latch mechanism, and in particular, the contact forces become substantially less the further away from the central tapered elements (contact numbers 11–23).

Figure 3A:
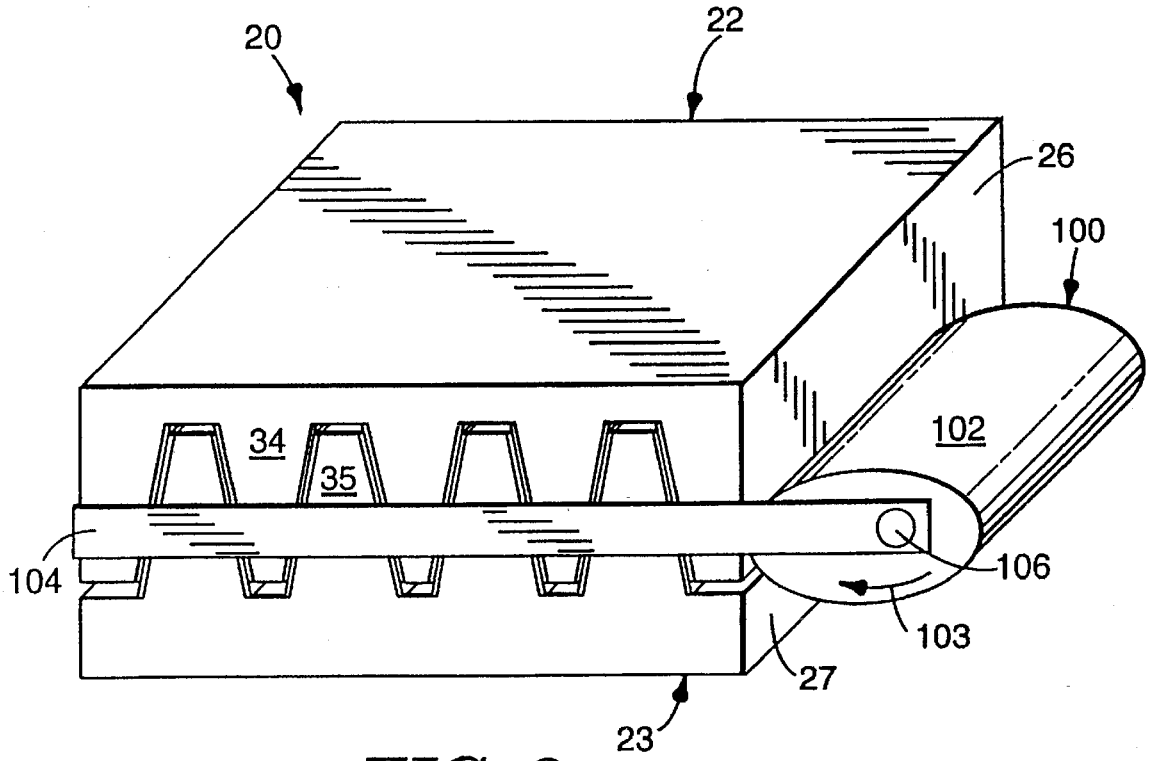
FIGS. 3*a* and 3*b* are perspective views of a second latch mechanism of the present invention.
Figure 3B:
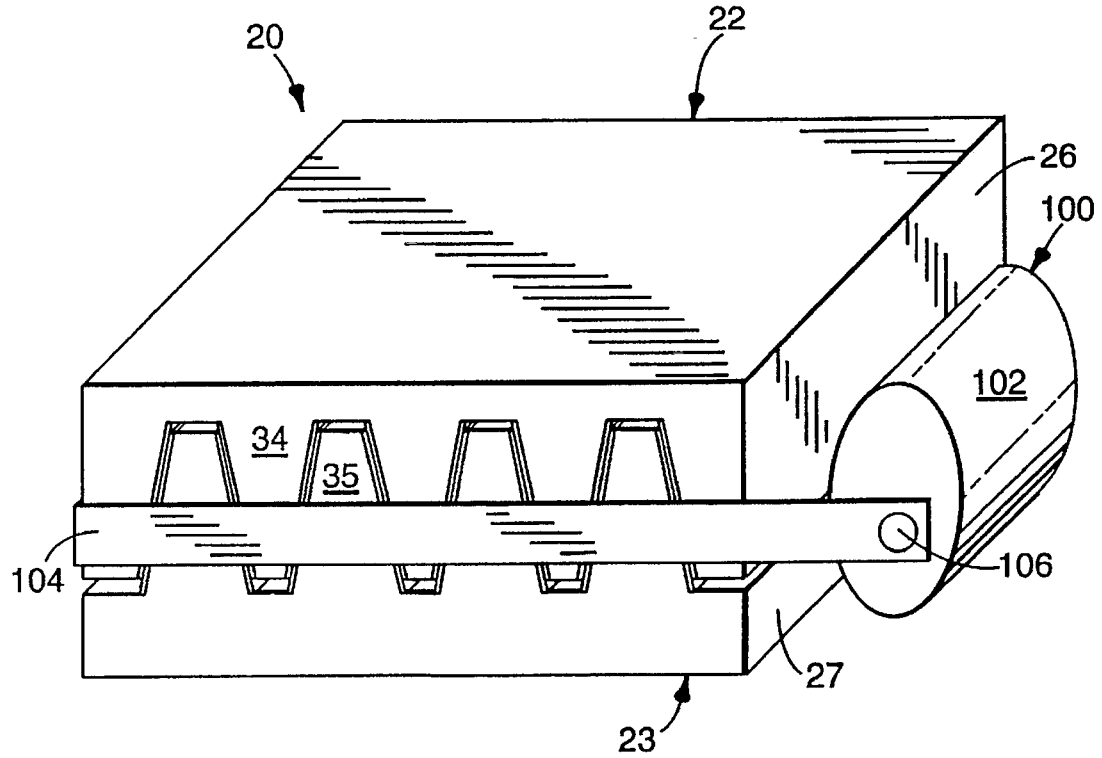

FIGS. 3*a* and 3*b* show the locking taper electrical connector 20 having latching forces along its vertical axis enhanced by a cam member 100. This cam member 100 includes a rotatable cam 102, with a band 104 attached to opposite ends of the cam 102 by pins 106 or other similar structures. The cam 102 is preferably an oblong shaped member which may be rotated into the latch position (in the direction of the arrow 103), as shown in FIG. 3*a*, by a standard screwdriver or other equivalent turning mechanism. The band 104 preferably extends around the upper member 22, and supports the load of the cam 102 acting on the upper member 22.

Alternately, the band 104 may be shortened such that it is preferably attached at opposite sides of the upper member 22 at the tapered elements 34. It is also preferred that the band 104 be attached at opposite sides of the same tapered element 34. The attachments would be by mechanisms such as anchor pins, extending through the band and a sufficient distance into the tapered elements 34 to withstand the forces created when the cam 102 is rotated.

Figure 4:
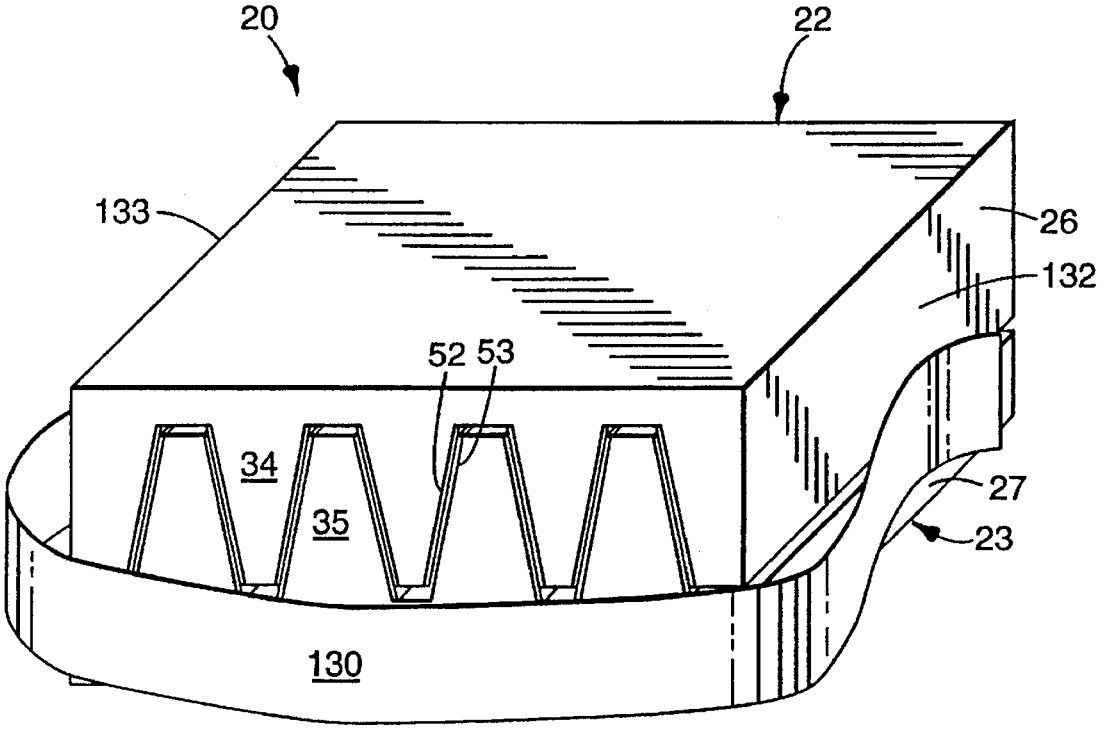
FIG. 4 is a perspective view of a third latch mechanism of the present invention.

FIG. 4 shows the locking taper connector 20 with a spring clip 130 over its ends. The spring clip 130 applies a latching force in the horizontal direction which can tolerate length differences in the connector body 26. The connector, and in particular the upper member 22, could be designed with recesses, molded into each of the ends of the body 26, along the flat surface areas 132, 133, such that the latch force could be removed from the connector 20, while the spring clip 130 would not be completely removed from the connector 20. A relatively small movement of the clip 130 could bring it out of the recess and into the latching position.

It is preferred that the spring clip 130 be applied across one member, and in particular the upper member 22. This is due to the large portions of relatively flat surface area 132, 133 on the ends of body 26 of the upper member 22, which are able to better accommodate the spring clip 130.

Figure 5:
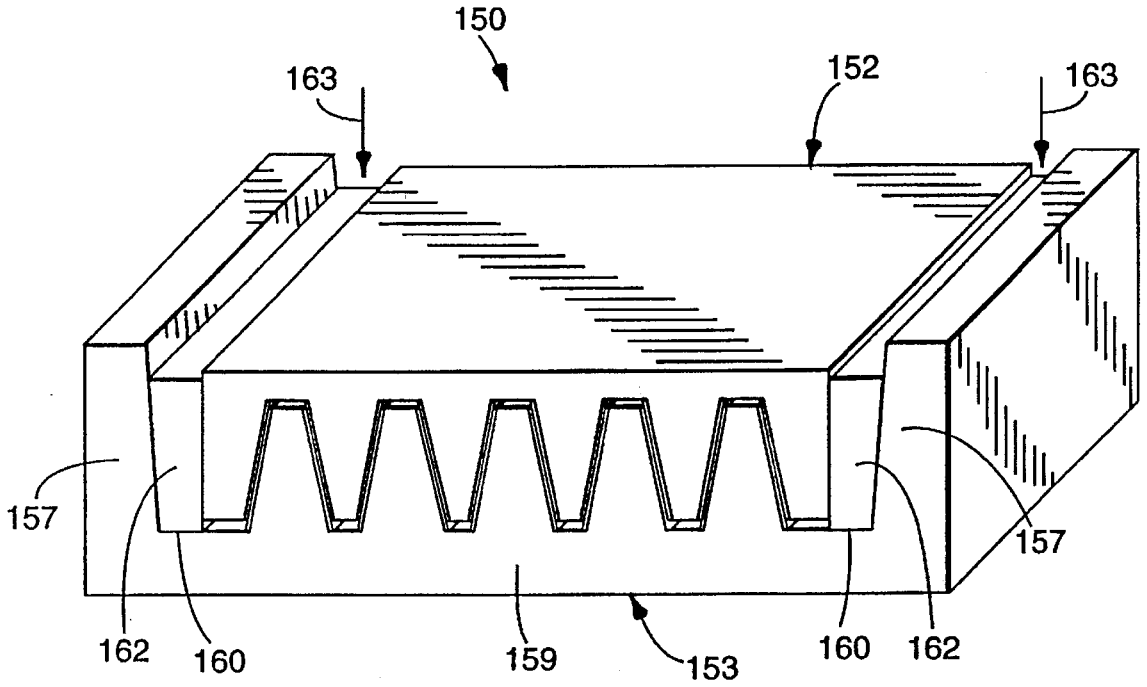
FIG. 5 is a perspective view of a fourth latch mechanism of the present invention.
Figure 6:
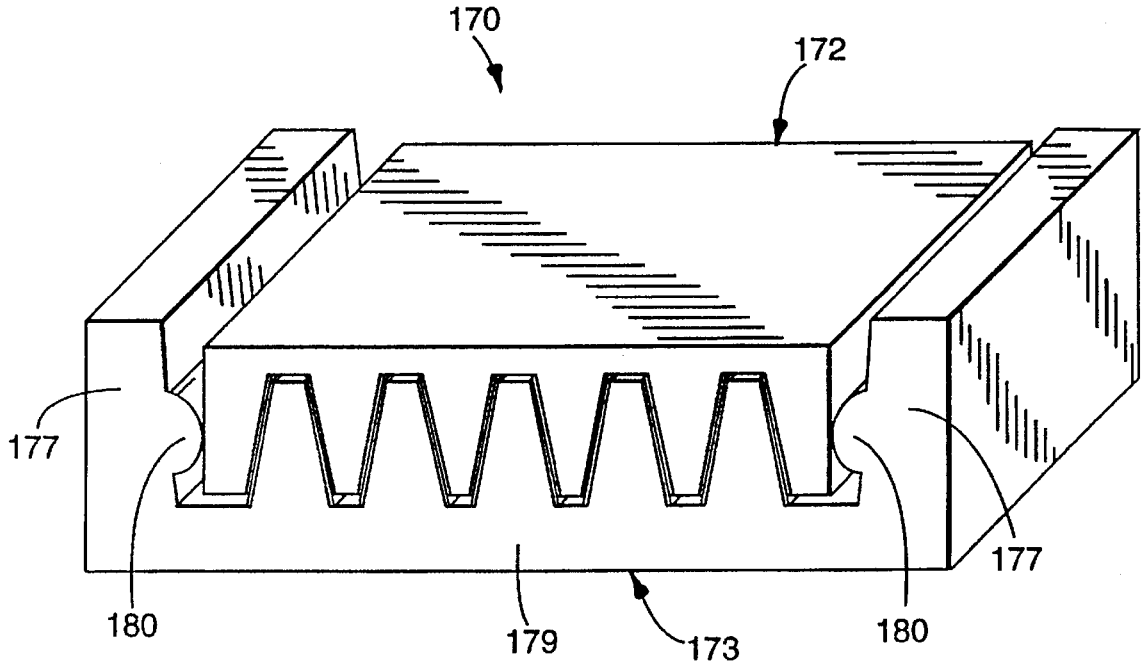
FIG. 6 is a perspective view of a fifth latch mechanism of the present invention.

FIGS. 5 and 6 show locking taper connectors 150, 170 with upper members 152, 172 similar to those disclosed in FIGS. 1–4 above, but different in that the lower members 153, 173 include shoulders 157, 177 extending upward from the bodies 159, 179 of the lower members 153, 173.

Specifically, the connector shown in FIG. 5 includes areas 160 between the shoulders 157, which receive wedges 162. The wedges 162 are pushed downward in the direction of arrows 163 to fit within the areas 160 with a tight tolerance, forming a frictional engagement with the upper member 152 and their respective shoulders 157. This wedging action provides sufficient force along the horizontal axis 60*a*, 60*b* (FIG. 1) of the upper member 152 to enhance the engagement forces along the vertical axis 62*a*, 62*b* (FIG. 1).

The connector of FIG. 6 includes protrusions 180 on the shoulders 177. When the members 172, 173 are brought into intermeshing contact, the protrusions 180 apply horizontal forces to the upper member 172. These horizontal forces along the horizontal axis 60*a*, 60*b* (FIG. 1) translate to forces which enhance the engagement forces along the vertical axis 62*a*, 62*b* (FIG. 1).

EXAMPLE

Locking taper connector parts, similar to those illustrated in FIG. 1, were injection molded from Ultem® (General Electric Company, Fairfield, Conn.) polyetherimide. The tapered elements were angled at a taper angle $\phi$ (FIG. 1), which was 3° from the vertical 62*a* (FIG. 1). Each tapered element had a crown to trough height h (FIG. 1) of 0.183 cm, and a periodicity p (FIG. 1) for the distance of a single ridge to the adjacent single groove of 0.127 cm. (Although the sample used in this Example was similar to that shown in FIG. 1, the geometries and dimensions for the sample are provided in relation to the components of FIG. 1 to show the geometries and dimensions of this similarly designed sample connector.)

A series of pull apart tests as function of clamp force were run. The test sample was bare Ultem®. No metalization was used on the locking tapers. The metalization was excluded to eliminate any variation in measured force due to nonuniformity in the metalization layer. Each half of the test sample contained eighteen tapered elements resulting in thirty-five locking faces. Overlap of the two connector members was 0.635 cm. The two connector member halves were inserted together with a force of 266.89 Newtons, applied by a spring tester designed to insure consistent force and parallel engagement.

An Instron® (Instron Corp., Canton, Mass.) Model 1122 force tester was used to measure the pull apart force of this connector pair while a known clamp force was applied to the edges of the connector members. The clamp force was applied by a spring actuated clamp, the spring of which had been calibrated for force versus deflection. The deflection of the spring could be varied and hence the clamp force varied to known levels.

Four individual pull apart measurements were averaged for each test condition. Table 1 (below) lists the measured pull apart force versus clamp force. The data clearly indicates that the pull apart force can be doubled by the addition of a moderate amount of clamping force.

TABLE 1

| Clamp Force (Newtons) | Pull Apart Force (Newtons) |
|---|---|
| 0 | 47.60 |
| 66.72 | 52.49 |
| 200.17 | 68.50 |
| 346.96 | 91.63 |

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. An electrical connector comprising:

a first member having a major surface including a plurality of electrically conducting tapered elements, each tapered element having at least one side inclined relative to a common plane at an angle sufficient to form a taper;

a second member having a major surface including a plurality of electrically conducting tapered elements correspondingly configured to the tapered elements of the first member;

the first member and the second member being intermeshable with each other at the major surfaces, the tapered elements of the first and second members forming a cooperative engagement with a force sufficient to ensure electrical connection, and upon intermeshing, the first and second members including a vertical axis normal to the major surfaces of the first and second members and a horizontal axis: (i) normal to the vertical axis and (ii) normal to a longitudinal axis of the tapered elements; and means for retaining the electrical connection between the first and second members, the retaining means applying a compressive force in a direction such that the compressive force has a non-zero component along the horizontal axis, and located in part on the first member and in part on the second member, wherein the means for retaining comprises a hook on either of the first and second members and a corresponding receiving pin on the other of the first and second members.

2. An electrical connector as claimed in claim 1, wherein the direction in which the compressive force is applied is generally parallel to the horizontal axis.

3. An electrical connector comprising:

a first member having a major surface including a plurality of electrically conducting tapered elements, each tapered element having at least one side inclined relative to a common plane at an angle sufficient to form a taper;

a second member having a major surface including at least one electrically conducting tapered element correspondingly configured to the tapered elements of the first member;

the first member and the second member being intermeshable with each other at the major surfaces, the tapered elements of the first and second members forming a cooperative engagement with a force sufficient to ensure electrical connection, and upon intermeshing, the first and second members including a vertical axis normal to the major surfaces of the first and second members and a horizontal axis: (i) normal to the vertical axis and (ii) normal to a longitudinal axis of the tapered elements; and means for retaining the electrical connection between the first and second members, the retaining means applying a compressive force to at least one of the members in a direction such that the compressive force has a non-zero component along the horizontal, whereby the member retention force along the vertical axis is increased, wherein the means for retaining is selected from the group consisting of:

(a) at least one hook and a corresponding receiving pin, wherein the hook and receiving pin are on the first member;

(b) a spring clip attached to at least one of the first and second members;

(c) a cam member connected to a band, the cam and the band extending around the first member; and (d) a cam member connected to a first band and a second band, the first band attached to a tapered element on one side of the first member and the second band attached to a tapered element on the opposite side of the first member, the cam member and the first and second bands extending around at least a portion of the first member.

4. The electrical connector of claim 3, wherein the hook and corresponding receiving pin are on different tapered elements.

5. The electrical connector of claim 3, wherein the first member includes oppositely disposed ends and the spring clip attaches to the ends of the first member.

6. The electrical connector of claim 3, wherein the first and second bands are attached to the same tapered element.

7. An electrical connector as claimed in claims 3, wherein the direction in which the compressive force is applied is generally parallel to the horizontal axis.

8. An electrical connector comprising:

a first member having a major surface including a plurality of electrically conducting tapered elements, each tapered element having at least one side inclined relative to a common plane at an angle sufficient to form a taper;

a second member having a major surface including a plurality of electrically conducting tapered elements correspondingly configured to the tapered elements of the first member;

the first member and the second member being intermeshable with each other at the major surfaces, the tapered elements of the first and second members forming a cooperative engagement with a force sufficient to ensure electrical connection, and upon intermeshing, the first and second members including a vertical axis normal to the major surfaces of the first and second members and a horizontal axis: (i) normal to the vertical axis and (ii) normal to a longitudinal axis of the tapered elements; and means for applying a compressive force to at least one of the members in a direction generally parallel to the horizontal axis, whereby the retention force along the vertical axis is increased, maintaining the electrical connection between the first and second members, wherein the means for applying force is selected from the group consisting of:

(a) at least one hook and a corresponding receiving pin, wherein the hook and receiving pin are on the first member;

(b) a spring clip attached to at least one of the first and second members;

(c) a cam member connected to a band, the cam and the band extending around the first member; and (d) a cam member connected to a first band and a second band, the first band attached to a tapered element on one side of the first member and the second band attached to a tapered element on the opposite side of the first member, the cam member and the first and second bands extending around at least a portion of the first member.

9. The electrical connector of claim 8, wherein the hook and corresponding receiving pin are on different tapered elements.

10. The electrical connector of claim 8, wherein the first member includes oppositely disposed ends and the spring clip attaches to the ends of the first member.

11. The electrical connector of claim 8, wherein the first and second bands are attached to the same tapered element.

* * * * *